US010553415B2

(12) United States Patent
Hoyes

(10) Patent No.: US 10,553,415 B2
(45) Date of Patent: Feb. 4, 2020

(54) STANDING WAVE ION MANIPULATION DEVICE

(71) Applicant: Micromass UK Limited, Wilmslow (GB)

(72) Inventor: John Brian Hoyes, Mellor (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/315,587

(22) PCT Filed: Jul. 5, 2017

(86) PCT No.: PCT/GB2017/051981

§ 371 (c)(1),
(2) Date: Jan. 4, 2019

(87) PCT Pub. No.: WO2018/007810

PCT Pub. Date: Jan. 11, 2018

(65) Prior Publication Data

US 2019/0304765 A1 Oct. 3, 2019

(30) Foreign Application Priority Data

Jul. 5, 2016 (GB) ..... 1611732.7

(51) Int. Cl.
*H01J 49/00* (2006.01)
*H01J 49/06* (2006.01)
(Continued)

(52) U.S. Cl.
CPC ..... *H01J 49/062* (2013.01); *H01J 49/40* (2013.01); *H01J 49/421* (2013.01)

(58) Field of Classification Search
CPC .. H01J 49/00; H01J 49/02; H01J 49/06; H01J 49/062; H01J 49/065; H01J 49/066; H01J 49/26; H01J 49/4225
(Continued)

(56) References Cited

U.S. PATENT DOCUMENTS 8,373,120 B2 2/2013 Verentchikov
8,835,839 B1 9/2014 Anderson et al.
(Continued)

FOREIGN PATENT DOCUMENTS

WO 2010014077 A1 2/2010
WO 2015191569 A1 12/2015

OTHER PUBLICATIONS

International Search Report and Written Opinion for International Application No. PCT/GB2017/051981 dated Sep. 21, 2017, 14 pages.

(Continued)

*Primary Examiner* — Jason L McCormack

(57) ABSTRACT

An ion manipulation device is disclosed comprising: an ion receiving region (30) for receiving ions; a pair of electrodes (14,16) adjacent the ion receiving region (30); and an AC or RF voltage supply (18) arranged to apply an AC or RF voltage to said electrodes (14,16), or arranged and configured to generate an electromagnetic field that couples to said electrodes (14,16) in use, such that an electromagnetic standing wave (24) is generated between said electrodes (14,16). A first of the electrodes (14) comprises one or more apertures through which an electric field from the standing wave (24) penetrates and enters the ion receiving region (30), in use, for urging said ions away from the one or more apertures.

20 Claims, 9 Drawing Sheets

(51) Int. Cl.
*H01J 49/40* (2006.01)
*H01J 49/42* (2006.01)

(58) Field of Classification Search
USPC ..... 250/281, 282, 292
See application file for complete search history.

(56) References Cited

U.S. PATENT DOCUMENTS

| | | | | |
|---|---|---|---|---|
| 8,901,490 | B1 | 12/2014 | Chen et al. | |
| 8,907,273 | B1 | 12/2014 | Chen et al. | |
| 2001/0035498 | A1 | 11/2001 | Li et al. | |
| 2009/0127457 | A1* | 5/2009 | Guevremont ..... | G01N 27/624 250/292 |

OTHER PUBLICATIONS

Search Report under Section 17 for United Kingdom Application No. GB1611732.7 dated Dec. 9, 2016, 5 pages.
Zuleta et al., "Micromachined Bradbury-Nielsen Gates", Analytical Chemistry, 79(23): 9160-9165, Dec. 1, 2007.
Gerlich, "Inhomogeneous RF fields: A Versatile Tool for the Study of Processes with Slow Ions", State-Selected and State-to-State Ion-Molecule Reaction Dynamics, Part 1: Experiment, Edited by Cheuk-Yiu Ng and Michael Baer, Advances in Chemical Physics Series, vol. 82, pp. 1-176.

* cited by examiner

STANDING WAVE ION MANIPULATION DEVICE

CROSS-REFERENCE TO RELATED APPLICATIONS

This application is a national phase filing claiming the benefit of and priority to International Patent Application No. PCT/GB2017/051981, filed on Jul. 5, 2017, which claims priority from and the benefit of United Kingdom patent application No. 1611732.7 filed on Jul. 5, 2016, the entire contents of which are incorporated herein by reference.

FIELD OF THE INVENTION

The present invention relates generally to mass spectrometers and in particular to devices for guiding, trapping or pulsing ions.

BACKGROUND

It is desirable to miniaturise mass spectrometers and components thereof to produce smaller instruments, but also for other reasons such as in order to reduce the phase space volume of a component. For example, such phase space reduction may be particularly advantageous in preparing an ion beam for acceleration in Time of Flight (TOF) instruments. In particular, it is envisaged that aberrations of the ion beam in terms of the initial positions and velocity spreads of the ions may be reduced in order to increase the resolution of these instruments.

It is understood that in order reduce the geometric scale of a device that confines ions using an RF voltage, it is necessary to increase the frequency of the RF voltage correspondingly, in order to maintain stability of the confined ions. However, the effective potential generated by the RF voltage scales in inverse proportion to the square of the RF voltage frequency, so in order to create a strong enough effective potential for ion confinement the field strength must be increased according. Other difficulties also arise in miniaturising RF confinement devices. For example, difficulties may be encountered in miniaturising RF ions guides formed from stacks of ring electrodes or multipoles, since they comprise a relatively complex array of optical elements requiring individual voltage connections to adjacent optical elements.

U.S. Pat. No. 8,373,120 (Verentchikov) proposes a method of trapping ions by applying an RF voltage between a plate electrode and a wire mesh electrode, such that an oscillating electric field penetrates through the wire mesh in a direction away from the plate electrode. This penetrating field creates an array of effective potential barriers or wells corresponding to the pitch of the mesh. This device is relatively simple, since there are only a few macroscopic electrical connections required for the device.

It is desired to provide an improved ion manipulation device, an improved mass or ion mobility spectrometer, and an improved method of spectrometry.

SUMMARY

From a first aspect, the present invention provides an ion manipulation device comprising:

an ion receiving region for receiving ions;

a pair of electrodes adjacent the ion receiving region; and an AC or RF voltage supply arranged to apply an AC or RF voltage to said electrodes, or arranged and configured to generate an electromagnetic field that couples to said electrodes in use, such that an electromagnetic standing wave is generated between said electrodes;

wherein a first of the electrodes comprises one or more apertures through which an electric field from the standing wave penetrates and enters the ion receiving region, in use, for urging said ions away from the one or more apertures.

By using the effective potential from the standing wave to penetrate into the ion receiving region, the device of the present invention is able to employ relatively high frequency AC or RF voltages. This enables the size of the device to be miniaturised without the problems discussed herein. Such miniaturization is desirable in order to produce smaller instruments, but also to reduce the phase space volume of the device, e.g. to prepare an ion beam for acceleration in TOF instruments. In particular, embodiments are envisaged in which aberrations of the beam in terms of initial position and velocity spreads may be reduced in order to increase the resolution of these instruments.

The present invention resides, in part, in recognising that the increase in oscillating frequency of the electric field means that the physical size of the ion optical device now becomes significant in comparison to the wavelength of the driving electromagnetic field. As such, the quasistatic field approximation used in the low megahertz regime is no longer applicable and the field strength varies along the length of the RF confining device. The embodiments of the present invention provide a device and method for driving such an ion optical device by incorporating it within a microwave resonator construction that supports transverse electromagnetic (TEM) modes of wave propagation.

Although a pair of electrodes are described herein, it will be appreciated that more than two electrodes may be used according to the techniques described herein.

The device may further comprise a trapping electrode facing the apertures so as to define said ion receiving region therebetween, and a voltage supply configured to supply a potential difference between the trapping electrode and the one or more apertures for urging ions in a direction towards the apertures.

The voltage supply for urging ions in a direction towards the apertures may be a DC voltage supply.

The electrodes may be planar plate electrodes.

The electrodes may be arranged in parallel with each other.

The electrodes may have a length along an axis that the standing wave is generated that is an integer number of quarter wavelengths of the electromagnetic wave forming the standing wave. For example, the electrodes may have a length along the axis that the standing wave is generated that is equal to half a wavelength of the electromagnetic wave.

Each of the pair of electrodes may have a length in a direction parallel to the axis of the standing wave and a width in a dimension orthogonal to the axis of the standing wave, wherein the width of each electrode increases and/or decreases along its length.

The first electrode may have a narrow portion comprising said one or more apertures and a wider portion at, or towards, one or both longitudinal end of the first electrode.

The width of the electrode may progressively taper from the narrow portion to the wider portion at one or both longitudinal ends of the first electrode.

The device may comprise a solid dielectric material arranged between the pair of electrodes.

The solid dielectric material may be a substrate of a printed circuit board, optionally wherein the electrodes are printed on the printed circuit board.

The first electrode may be a sheet metal electrode having said one or more apertures therethrough.

The first electrode may be a mesh or comprise a mesh providing said apertures; optionally wherein said mesh is a grid or is a plurality of wires defining elongated apertures between the wires.

The first electrode may comprise a non-apertured sheet portion and a portion having said one or more apertures.

The one or more apertures may be arranged so as to be adjacent an anti-node of the standing wave, in use.

Each electrode of the pair of electrodes may have first and second longitudinal ends and a length extending therebetween, wherein the electrodes are spaced apart, and wherein the first ends of the electrodes are electrically connected to each other and the second ends of the electrodes are electrically connected to each other.

The first ends and/or second ends of the electrodes may be electrically connected so as to form a short circuit.

The first ends and/or second ends may be electrically connected by a load that is not impedance matched to the electrodes. This causes a partial reflection of the electromagnetic waves generated by the RF voltage supply, so as to generate the standing wave.

The device may comprise a controller for varying the impedance of the load with time. For example, the controller may apply a voltage to the load that varies with time so as to vary the impedance of the load with time. By way of example, the load may comprise a capacitor and/or inductor and the controller may vary the capacitance of the capacitor and/or the inductance or the inductor with time.

The nodes and anti-nodes of the standing wave may cause the electric field penetrating through the one or more apertures into the ion receiving region to have at least one potential well in the direction along the axis of the standing wave. Ions may be axially trapped in this at least one well. Varying the impedance of the load with time moves the positions of the nodes and antinodes of the standing wave with time, thus driving ions in the at least one potential well through the ion receiving region.

The AC or RF voltage supply may be configured to generate the AC or RF voltage having a frequency of: ≥20 MHz; ≥40 MHz; ≥60 MHz; ≥80 MHz; ≥100 MHz; ≥120 MHz; ≥140 MHz; ≥160 MHz; ≥180 MHz; or ≥200 MHz.

Each of the pair of electrodes may have a length in a direction parallel to the axis of the standing wave, wherein the AC or RF voltage supply may be connected to these electrodes so as to supply the AC or RF voltage to the electrodes at locations half way along the lengths of the electrodes.

The AC or RF voltage supply may be arranged and configured to generate an electric field that inductively couples to said electrodes in use.

The AC or RF voltage supply and the electrodes may form a resonator, e.g. a microwave resonator. Alternatively, the AC or RF voltage supply may form a resonator (e.g. microwave resonator) that is coupled to the pair of electrodes, for example by inductive coupling, so as to generate the standing wave between the pair of electrodes. Further, alternatively, a voltage amplifier may be connected to the pair of electrodes so as to generate the standing wave between the pair of electrodes.

The ion manipulation device may be either: an ion guide for guiding ions through the ion receiving region; an ion trap for trapping ions in the ion receiving region; an ion accelerator for pulsing ions out of the ion receiving region; an ion fragmentation or reaction device for fragmenting or reacting ions in the ion receiving region; a mass filter for mass filtering ions; or a mass analyser.

The first electrode may comprise a plurality of apertures (e.g. defined by the mesh comprising a plurality of parallel wires). This enables the electric field to penetrate through each aperture into the ion receiving region. Accordingly, the device may be an ion guide having a plurality of ion guiding regions, or an ion trap comprising a plurality of ion trapping regions.

The device may comprise a gas pump for creating a gas flow for urging ions through the ion receiving region; and/or may comprise a voltage supply, electrodes and a controller configured and set up to generate and electric or magnetic field for urging ions through the ion receiving region.

For example, a plurality of electrodes may be axially spaced along the ion receiving region and electrical potentials may be applied to these electrodes so as to generate an electric field that drives ions through the ion receiving region. A static potential gradient may be arranged along the ion receiving region, or a voltage may be successively applied to successive electrodes along the ion receiving region so as to form a voltage wave that drives ions through the ion receiving region.

The device may be configured to maintain the ion receiving region at a pressure of: (i)< about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; or (viii) about 100-1000 mbar. Alternatively, the device may be configured to maintain the ion receiving region at a pressure of: (i)>0.0001 mbar; (ii)>0.001 mbar; (iii)>0.01 mbar; (iv)>0.1 mbar; (v)>1 mbar; (vi)>10 mbar; or (vii)>100 mbar. For example, the ion receiving region may be maintained at a relatively high pressure and ions may be driven though the high pressure gas such that the ions separate according to ion mobility.

The inventor has also recognised that the pair of electrodes may be in the form of a transmission line terminated by a load that is impedance matched to the electrodes of the transmission line. In this special case, there is substantially no reflection of the electromagnetic wave at the load. As such, a substantially constant mean AC/RF voltage profile may be provided between and along the length of electrodes, and the resulting electric field penetrates through the aperture into the ion receiving region so as to repel ions.

Accordingly, from a second aspect the present invention provides an ion manipulation device comprising:

an ion receiving region for receiving ions;

a transmission line arranged adjacent to the ion receiving region, wherein the transmission line comprises a pair of electrodes for transmitting electromagnetic waves terminated by a load that is impedance matched to the transmission line; and an AC or RF voltage supply arranged to apply an AC or RF voltage to said electrodes, or arranged and configured to generate an electromagnetic field that couples to said electrodes in use;

wherein a first of the electrodes comprises one or more apertures through which an electric field of said electromagnetic waves penetrates and enters the ion receiving region, in use, for urging said ions away from the one or more apertures.

The device may have any of the optional features described in relation to the first aspect of the present invention (except that the device need not set up a standing wave between the electrodes).

The present invention also provides a mass or ion mobility spectrometer comprising the device described herein.

The spectrometer may comprise a flight region and the device may be configured to pulse ions from the ion receiving region into the flight region.

The spectrometer may be a time of flight mass spectrometer.

The first aspect of the present invention also provides a method of mass or ion mobility spectrometry comprising:

providing an ion manipulation device as described in relation to the first aspect of the present invention;

supplying ions to, or generating ions in, said ion receiving region;

applying said AC or RF voltage to said pair of electrodes, or generating an electromagnetic field with said AC or RF voltage supply that couples to said electrodes, such that an electromagnetic standing wave is generated between said electrodes and said electric field from the standing wave penetrates through said one or more apertures and enters the ion receiving region so as to urge ions away from the one or more apertures.

The ion manipulation device used in the method may comprise any of the features described above.

For example, the method may comprise providing a trapping electrode facing the apertures so as to define said ion receiving region therebetween, and applying a potential difference between the trapping electrode and the one or more apertures so as to urge ions in a direction towards the apertures.

The potential difference may be a DC potential difference.

The method may comprise arranging the one or more apertures so as to be adjacent an anti-node of the standing wave.

Each electrode of the pair of electrodes may have first and second longitudinal ends and a length extending therebetween, wherein the electrodes are spaced apart, and wherein the first ends of the electrodes are electrically connected to each other and the second ends of the electrodes are electrically connected to each other.

The first ends and/or second ends of the electrodes may be electrically connected so as to form a short circuit.

The nodes and anti-nodes of the standing wave may cause the electric field penetrating through the one or more apertures into the ion receiving region to have at least one potential well in the direction along the axis of the standing wave. Ions may be axially trapped in this at least one well.

The first ends and/or second ends may be electrically connected by a load that is not impedance matched to the electrodes. This causes a partial reflection of the electromagnetic waves generated by the RF voltage supply, so as to generate the standing wave.

The method may comprise varying the impedance of the load with time such that the position of the nodes and antinodes of the standing wave move with time, thus driving ions in the at least one potential well through the ion receiving region. This may be achieved, for example, by applying a time varying voltage to the load so as to vary the impedance of the load with time.

The AC or RF voltage may have a frequency of: ≥20 MHz; ≥40 MHz; ≥60 MHz; ≥80 MHz; ≥100 MHz; ≥120 MHz; ≥140 MHz; ≥160 MHz; ≥180 MHz; or ≥200 MHz.

The method may comprise pulsing ions out of the ion receiving region, e.g. into a time of flight region of a TOF mass spectrometer or into a drift region of an ion mobility spectrometer.

The second aspect of the present invention also provides a method of mass or ion mobility spectrometry comprising:

providing an ion manipulation device as described in relation to the second aspect of the invention;

supplying ions to, or generating ions in, said ion receiving region;

applying said AC or RF voltage to said pair of electrodes, or generating an electromagnetic field with said AC or RF voltage supply that couples to said electrodes, such that an electromagnetic wave travels along the transmission line and an electric field from the electromagnetic wave penetrates through said one or more apertures and enters the ion receiving region so as to urge ions away from the one or more apertures.

Various embodiments described herein provide a construction that acts as a resonator that is an integral multiple of a quarter wavelengths in length of the oscillating electromagnetic radiation. Such a resonator allows for high Q-factors of several hundred and knowledge of the standing wave pattern allows optimum positioning of the optical element within the device. Additionally, such a resonator can be configured to drive a transmission line with a variable impedance load. By tuning the load a standing wave pattern of desired ratio and phase can be created on the line. Thus a highly simplified high frequency travelling wave ion guide can be fabricated using only three active optical elements.

The spectrometer of the embodiments may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion mobility separation devices and/or one or more Field Asymmetric Ion Mobility Spectrometer devices.

The spectrometer may comprise one or more collision, fragmentation or reaction cells.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi)> about 500 V peak to peak.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

A chromatography detector may be provided, wherein the chromatography detector comprises either: a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
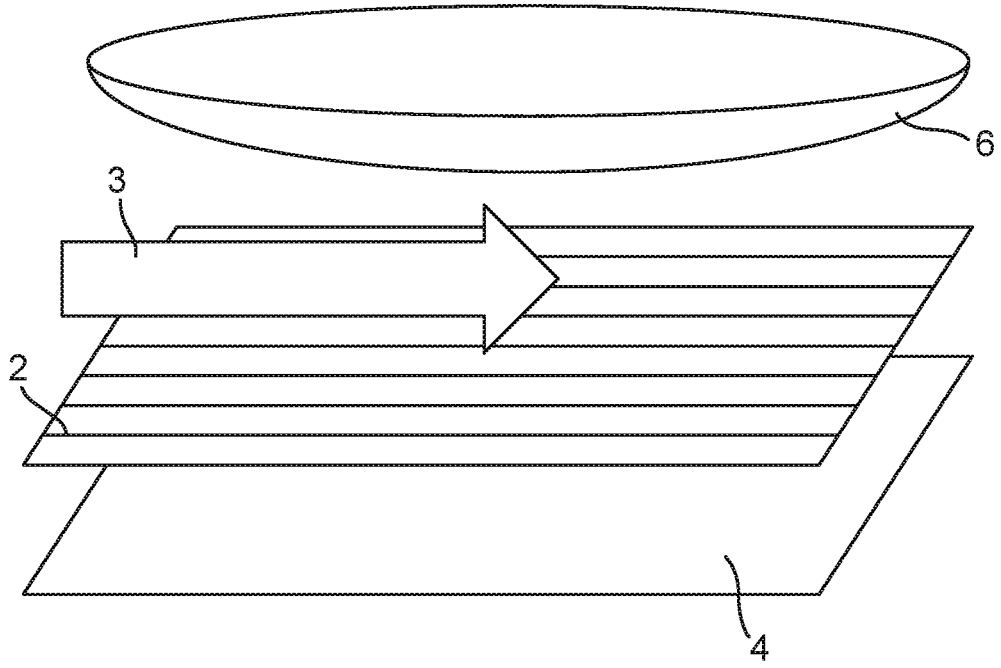
FIG. 1 shows a schematic of a prior art ion guide.

Ion optical elements employed in mass spectrometers may be utilized to create static or dynamic electric or magnetic fields. Static fields satisfy the first two of Maxwell's equations; Gauss's law for electrostatic fields and Gauss's law for magnetostatic fields. The behaviour of elements such as fixed magnets, einzel lenses, electrostatic analysers can be characterized by these two laws. Certain optical elements in mass spectrometers employ time varying fields for ion confinement, separation or acceleration of ions. Examples of these dynamic elements include scanning magnets or electric sectors, radio frequency ion guides, quadrupole mass analysers and ion traps, pushers for TOF instruments etc. Generally speaking, the rate of variation of electric field in the above devices is slow enough to apply the quasistatic approximation, i.e. to solve the field equations using the above two laws and impose a time varying modulation to the static solution so as to give the electric fields and work out ion trajectories. This approximation may be used because the wavelength of the electromagnetic wave is long in comparison to the physical dimensions of the ion optical component in question. Put another way, the speed of light is fast enough that propagation delays across the optical element can be ignored. For example, a typical quadrupole mass analyser is 0.2 m long and has a time varying electric field of 1 MHz frequency applied to it. An electromagnetic wave of this frequency has a wavelength of 300 m, which is much greater than the size of the optical element in question and so the propagation characteristics of the fields can be ignored in this case and the applied RF voltage can be considered to be constant across the optical element.

However, as the frequency of the electromagnetic field increases its wavelength decreases and can become comparable to the dimensions of the ion optical component to which it is applied. In this event, the last two time dependent Maxwell's equations must be considered, i.e. Faraday's law of Induction and Ampere's law (with Maxwell's extension), which introduce the dynamic behaviour of the electric and magnetic fields and their interaction in order to characterise the ion optical system.

The radio frequency ion guides mentioned above are commonly used in mass spectrometers to confine ions. The force on a single charged ion due to the effective potential is described by Gerlich (Inhomogeneous RF fields; A versatile tool for the study of processes with slow ions—Dieter Gerlich). The height, in volts, of the effective potential is given by:

$$Veff = \frac{Eo^2 q}{4m\Omega^2} + \phi \tag{1}$$

where, the mass of the ion is m, q is the electronic charge, Eo the field strength of the oscillating field of frequency Ω, and ϕ is the electrostatic potential.

Typically such ion guides are of the order of tens of centimetres long and operate with RF voltage supplies having frequencies between 0.5 and 3 MHz. The quasistatic approximation for such fields is perfectly valid in this regime.

For the case of a single RF-only multipole ion guide that is elongated in the Z-direction, for example, then an ion beam may be confined in the centre of the ion guide with a cross sectional area of the order of the XY dimensions of the multipole itself. It is advantageous to reduce this area when preparing a beam for orthogonal acceleration (i.e. in the x-direction or y-direction) into a TOF region of the mass spectrometer. This is because the resolution/transmission performance of such an instrument scales in inverse proportion to phase space of the accelerated ion beam, i.e. small beams are more easily analysed in the TOF instrument. It is possible to reduce the cross sectional area of the ion beam in the XY plane simply by increasing the magnitude of the RF voltage supplied to the electrodes of the multipole ion guide, but eventually ions become unstable at high field strengths, as can be determined from the following relationship for stability:

$$\eta = \frac{2q|\nabla Eo|}{m\Omega^2} \tag{2}$$

where η is a dimensionless number known as the adiabaticity parameter, which for stable operation must be kept below a value of 0.3 (see Gerlich).

If the scale of an optical element is reduced while keeping all other parameters equal, then ions become unstable due to the increase in the term $|vE_0|$ in equation 2 above. Consequentially, it is understood that in order to reduce the cross sectional area of an ion beam in a multipole it is necessary to increase the frequency of operation in proportion with the reduction in geometric scale of the device in order to keep the ions stable and confined. Therefore, three difficulties arise as a consequence of the miniaturisation: firstly, there is a need to increase the electric field strength to compensate for the frequency dependent inverse square term in equation 1 above; secondly, there is a difficulty in mechanical construction of such small devices with discrete electrodes with differing applied potentials; and thirdly, there is limited space charge capacity of miniaturized devices due to their small volume.

U.S. Pat. No. 8,373,120 (Verentchikov) provides an instrument that alleviates some of these problems, as will be described with reference to FIGS. 1-3.

FIG. 1 shows a schematic of a device disclosed in U.S. Pat. No. 8,373,120. The device comprises a mesh electrode 2 arranged between a base plate electrode 4 and an upper electrode 6. An RF potential difference is applied between the base plate electrode 4 and the mesh electrode 2. The electric field generated between the base plate electrode 4 and the mesh electrode 2 penetrates through the apertures in the mesh electrode 2 and causes an array of effective potential wells or channels to be formed between the mesh electrode 2 and the upper electrode 6, thus creating an RF reflecting surface above the mesh electrode 2 which decays away in a direction towards the upper electrode 6. An electrostatic voltage may be applied to the upper electrode 6 so as to force ions towards the mesh electrode 2. The device therefore comprises an array of ion traps of small spatial extent. Ions 3 may therefore be introduced into the trapping regions.

Figure 2:
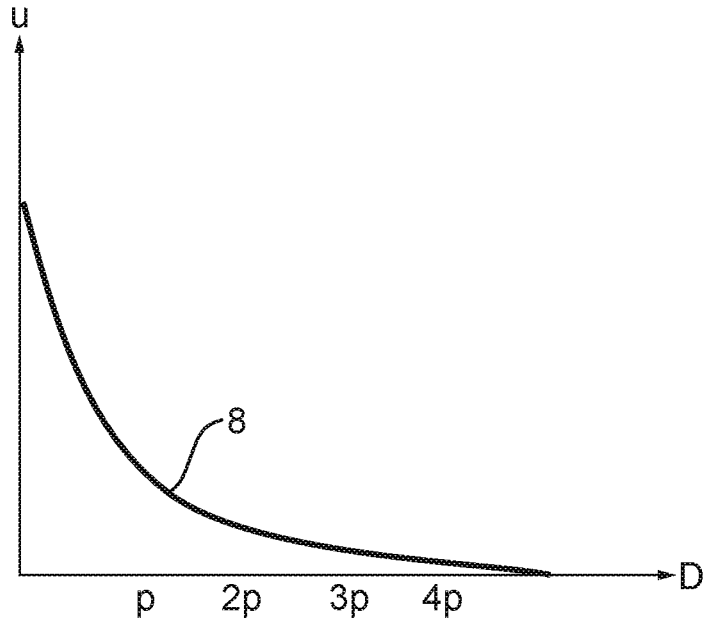
FIG. 2 shows the effective potential profile in the ion guide of FIG. 1.

FIG. 2 shows the magnitude U of the effective potential generated by the RF potential difference between the base plate electrode and the mesh electrode 2, as a function of distance D away from the mesh electrode 2 in the direction towards the upper electrode 6. The origin of the x-ordinate is at the mesh electrode 2. The unit of distance for the x-ordinate in FIG. 2 is the pitch size of the mesh electrode 2. It can be seen that the magnitude of the effective potential decays from the mesh electrode 2 towards the upper electrode 6, thus urging ions away from the mesh electrode 2 towards the upper electrode 6 (with a mass dependant force).

Figure 3:
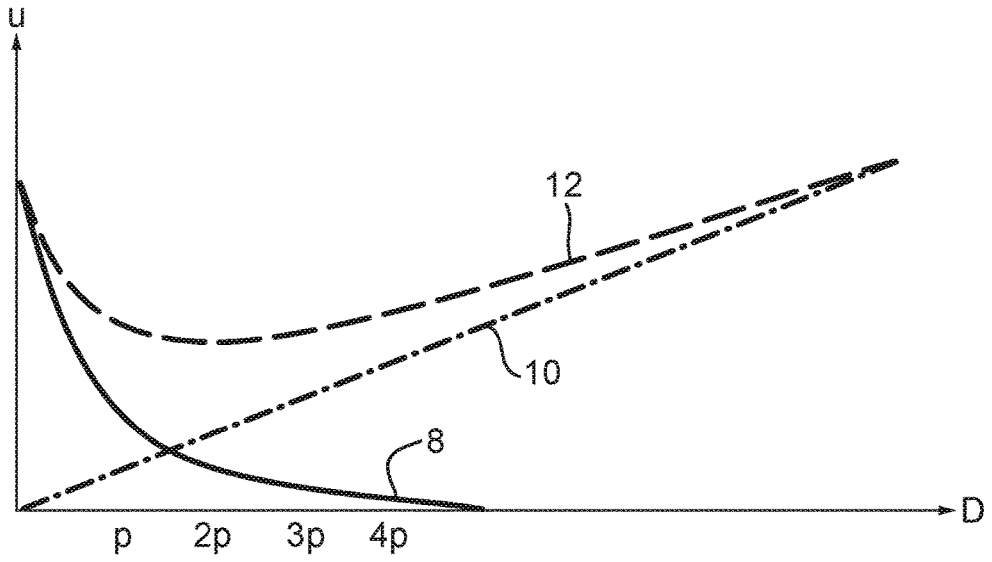
FIG. 3 shows effective potential profile, electrostatic potential profile and combined potential in the ion guide of FIG. 1.

FIG. 3 shows the effective potential 8 shown in FIG. 2 and also shows the linear potential profile 10 created by applying the electrostatic potential difference between the upper electrode 6 and the mesh electrode 2. The distance D at which the effective potential 8 and electrostatic potential 10 intercept corresponds to the location of the upper electrode 6. This electrostatic potential 8 decreases in a direction from the upper electrode 6 to the mesh electrode 2, thus urging ions towards the mesh electrode 2. The dashed plot 12 in FIG. 3 shows the combined potential obtained by summing the effective potential 8 and the electrostatic potential 10. It can be seen that the combined potential 12 forms a potential well having a minimum between the mesh electrode 2 and the upper electrode 6, which traps ions.

The device may be used to provide a high field strength by close coupling of the mesh electrode and adjacent electrode. Mechanical construction is also relatively simple due to the use of the mesh electrode, rather than an array of conductors having separate electrical feeds. Space charge may also be relatively high, since the device provides a plurality of potential wells due to the repeating structure of the mesh.

In order to reduce the size of the device it is necessary to reduce the scale of the mesh, but this requires the frequency of the RF voltage to be increased in order to maintain the ions in stable confinement. There comes a point where the macroscopic size of the device is comparable with the wavelength of the oscillating electromagnetic field and this may become problematic, for the reasons discussed above, and it is necessary to include the device as part of a structure within which the electromagnetic wave propagates.

Furthermore, as the frequency of the RF oscillator increases to, for example, 100 MHz and beyond the use of discrete "lumped" components (e.g. capacitors and inductors) becomes inefficient due to their increased resistive losses.

The embodiments of the present invention are capable of operating stably at relatively high frequencies and may therefore be made relatively small. The embodiments of the invention comprise a microwave structure that supports the desired voltage pattern in an ion optical device so as to create an effective potential force that confines and manipulates ions for mass spectrometry.

Various embodiments will now be described for creating a resonant circuit using distributed waveguide structures formed from parallel plate electrodes. However, it will be appreciated that embodiments of the present invention may use coaxial cables, a microwave stripline, hollow rectangular waveguides, or other configurations rather than parallel plate electrodes [e.g. see Fields and waves in communication Electronics—Ramo, Whinnery and Van Duzer. 3rd Edition]. Although the Q-factor of parallel plate waveguides in resonant structures is not as high as those achievable in hollow resonators, such as rectangular cavity devices, they have the advantage of supporting transverse electromagnetic modes (TEM) of propagation which have no low frequency cut off related to their transverse dimensions (e.g. see section 6.2 of Microwave Engineering—David M. Pozar. 4th Edition). This means that in addition to their high bandwidth capability they are amenable to miniaturization.

Figure 4:
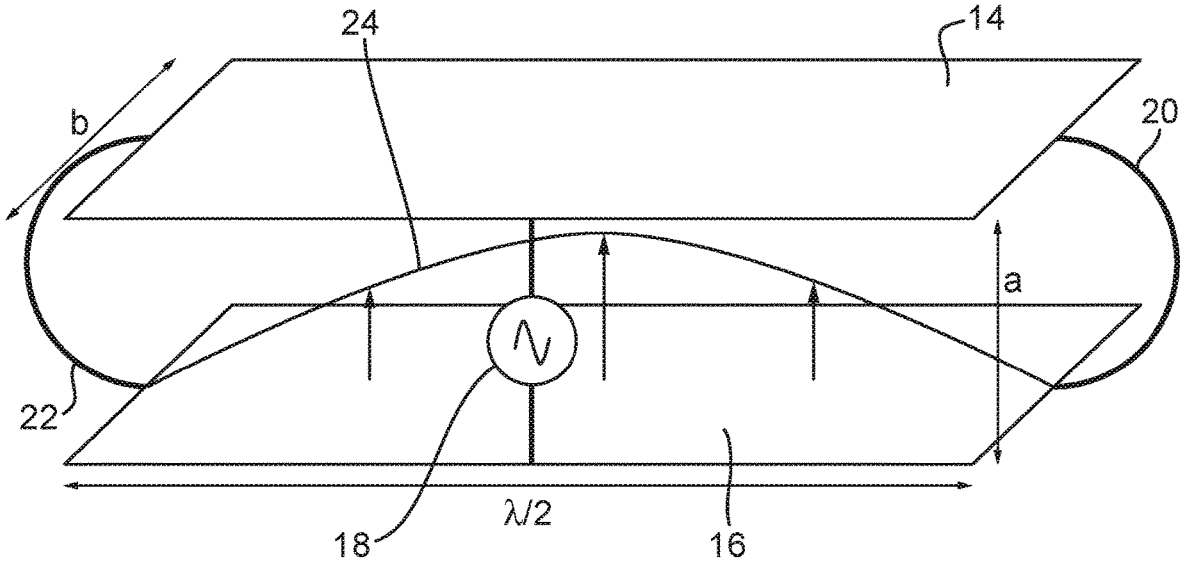
FIG. 4 shows a resonator according to an embodiment of the present invention.

FIG. 4 shows a side view of a schematic of a parallel plate resonator for use in accordance with embodiments of the present invention. The resonator comprises two parallel plate electrodes 14,16 that are spaced apart by a separation distance a. An RF voltage 18 supply is connected to the electrodes 14,16 so that different phases (preferably opposite phases) of the supply are connected to different plate electrodes 14,16, thereby applying an RF potential difference between the plate electrodes. The RF voltage supply may be connected to each plate electrodes half way along its length. The longitudinal end of each plate electrode is electrically connected by an electrical connector 20,22 to the adjacent longitudinal end of the other plate electrode so as to form a short circuit. When the RF voltage is applied to the plate electrodes 14,16 by the RF voltage supply 18, the electromagnetic wave travels towards the longitudinal ends of the plate electrodes and is reflected at the ends due to the short circuits. A standing wave 24 is therefore formed between the plate electrodes 14,16. In the device of FIG. 4, the wave is reflected such that crests of the wave are superimposed, i.e. the device is a resonator.

Each electrode 14,16 has a width b and a length corresponding to $\lambda/2$, wherein $\lambda$ is the wavelength of the electromagnetic wave giving rise to the standing wave. The wavelength $\lambda$ is dependent on the relative permittivity of the material between the plate electrodes 14,16. For example, a vacuum may be provided between the plate electrodes such that the relative permittivity between the plate electrodes is 1 and the wavelength is the wavelength of the RF voltage. Alternatively, a dielectric may be provided between the plate electrodes 14,16 having a higher relative permittivity, thereby reducing the wavelength $\lambda$ and hence enabling the device to be made smaller since it desirably has a length corresponding to an integer number of half wavelengths. For example, the plate electrodes 14,16 may be formed or mounted on opposing sides of a dielectric substrate.

Figure 5:
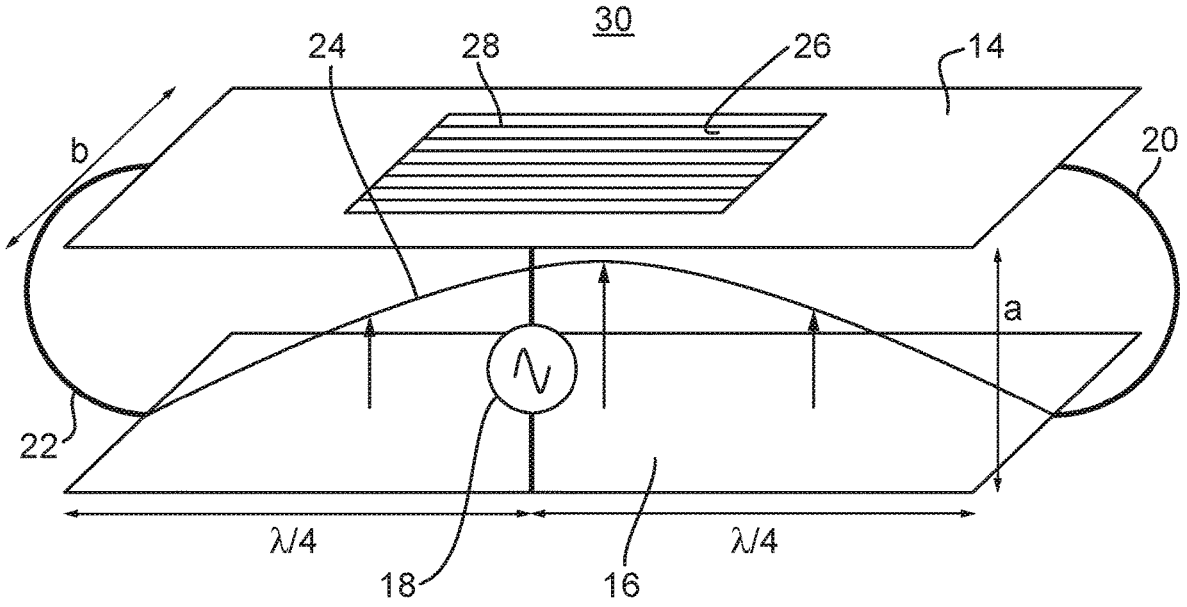
FIG. 5 shows an ion guide according to an embodiment of the present invention.

FIG. 5 shows a schematic of an embodiment of the present invention that is substantially the same as that shown in FIG. 4, except that one of the plate electrodes 14 has a plurality of apertures formed therein in the form of a mesh 26. In this example, the mesh 26 is in the upper electrode 14, although it could alternatively (or additionally) be in the lower plate electrode 16. The mesh 14 is depicted as a series of parallel wires 28 forming elongated apertures therebetween, although the mesh may alternatively be a grid. The presence of the mesh 26 enables the electromagnetic field generated by the RF voltage supply 18 to penetrate through the upper plate electrode 14 into an ion receiving region 30, which may be at a pressure below atmospheric pressure. The field is analogous to an evanescent wave, that is to say one that decays rapidly outside the medium without supplying power in that direction. This penetrating field may be used to urge ions in the ion receiving region 30 above the upper electrode 14 away from the upper electrode, for example, to guide or trap ions in the manner described in relation to the prior art device of FIGS. 1-3. However, the embodiment is advantageous in that it enables higher RF frequencies to be used, which enables the device to be smaller.

Figure 6A:
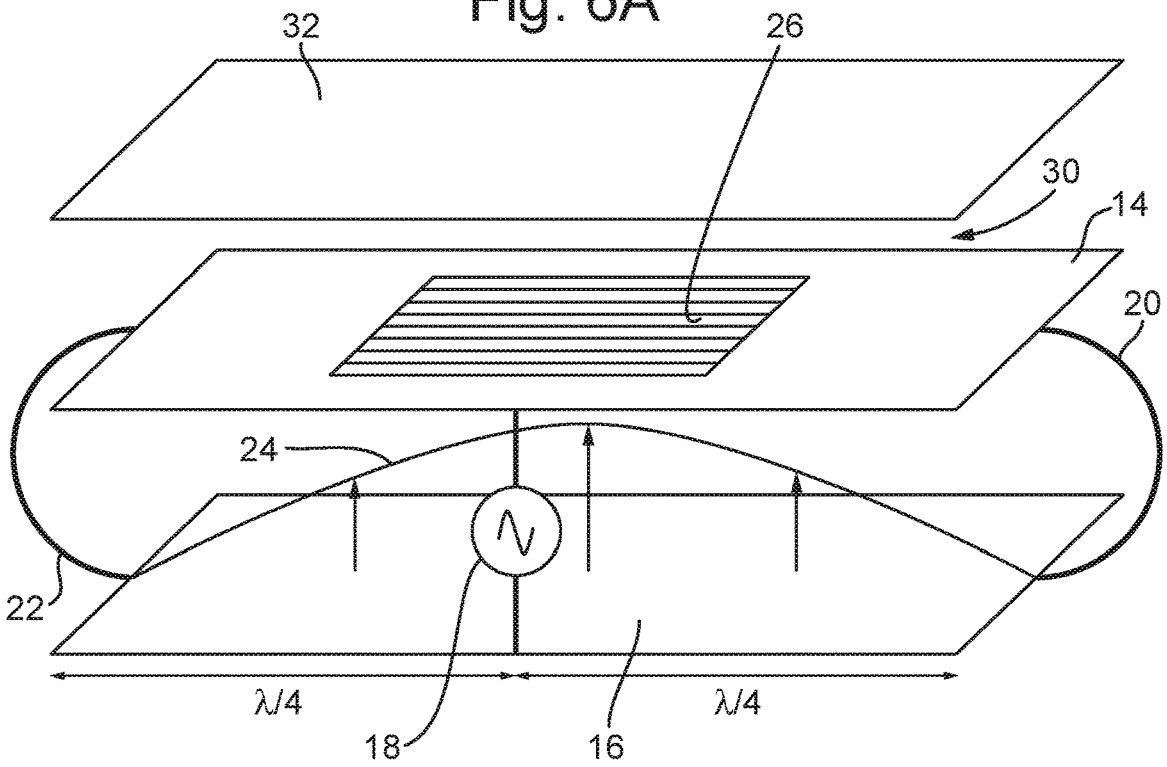
FIG. 6A shows an ion guide according to another embodiment having a trapping electrode.

FIG. 6A shows an embodiment that is substantially the same as that shown in FIG. 5, except that a trapping electrode 32 is provided above the upper plate electrode 14 which has the mesh 26 therein. The ion receiving region 30 is arranged between the trapping electrode 32 and upper plate electrode 14. A DC voltage may be supplied to the trapping electrode 32 so as to arrange a DC potential difference between the trapping electrode 32 and the electrode 14 having the mesh therein. This DC potential difference is arranged so as to drive the ions away from the trapping electrode 32 and towards the electrode 14 having the mesh therein. At a location between the mesh electrode 26 and the trapping electrode 32, the driving force on the ions caused by the DC potential difference is balanced by the opposing driving force on the ions due to the penetrating RF electric field. The ions are therefore confined in a potential well at this location. The device may therefore be used as an ion trap or an ion guide. For example, the device may be used to periodically pulse ions into a Time of Flight region.

Alternatively (or additionally), the mesh 26 may be provided in the lower plate electrode. In these embodiments, the trapping electrode 32 (or a trapping electrode), may be provided below the lower plate electrode 16.

Figure 6B:
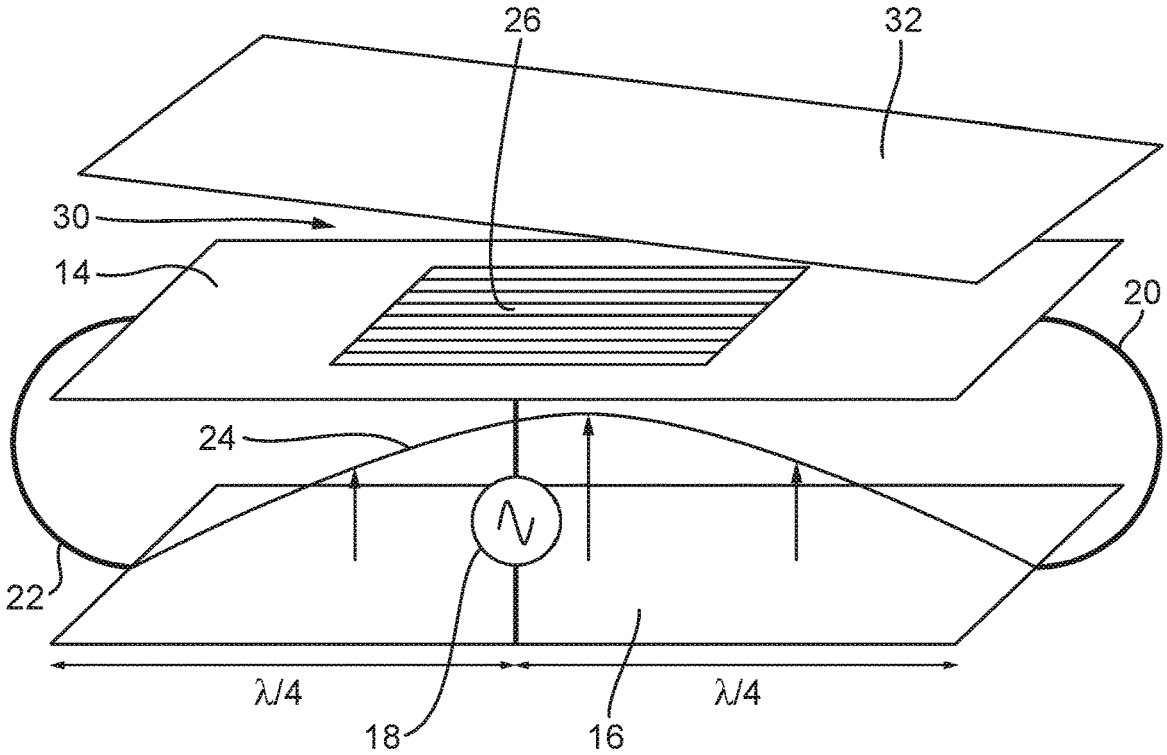
FIG. 6B shows an embodiment wherein a trapping electrode is arranged to urge ions along the device.

FIG. 6B shows an embodiment that is substantially the same as that shown in FIG. 6A, except that the plane of the trapping electrode 32 is arranged at an angle relative to the plane of the upper plate electrode 14. This results in an electric field along the axial length of the device that drives ions through the ion receiving region 30. Alternative, or additional, means of driving ions through the ion receiving region 30 are contemplated. For example, a plurality of electrodes may be axially spaced along the ion receiving region 30 and electrical potentials may be applied to these electrodes so as to generate an electric field that drives ions through the ion receiving region. A static potential gradient may be arranged along the ion receiving region 30, or a voltage may be successively applied to successive electrodes along the ion receiving region so as to form a voltage wave that drives ions through the ion receiving region. Alternatively, or additionally, a gas may be flowed through the ion receiving region 30 to drive ions therethrough.

Various parameters associated with practical embodiments of the invention will now be described. An effective potential having a magnitude of at least 1 volt may be desired to successfully confine ions at room temperature in a practical device. Equation 1 above defines that the effective potential is inversely proportional to mass of the ion, so if an upper m/z value of 1000 and a desired decade of m/z transmission by the ion guide are chosen, then the stability of ions having a m/z=100 must be considered according to equation 2 above. Another consideration is the width of the ion beam to be confined, which may be set at 3 mm for practical devices.

The behaviour of quarter wave resonators (similar to that shown in FIG. 5) driven by a high impedance voltage source at its anti-node and at a frequency of 100 MHz were examined and the results shown in Table 1 below. A variety of results for ions guides having materials of differing permittivities between the plate electrodes (a relative permittivity of 1 indicates that there is a vacuum gap between the plate electrodes) and having different sizes are shown in Table 1.

It is to be noted that the half wave resonator described in relation to FIGS. 4-6 is equivalent to two quarter wave resonators arranged back to back, which are fed by a voltage source in the middle and terminated at the ends by short-circuits. In Table 1 below the power requirements for quarter wave resonators are calculated.

For a quarter wave parallel plate resonator, the parameter Q is given by $Q=\beta/2\alpha c$, where $\beta$ is the propagation constant and $\alpha c$ the attenuation due to conductor losses. Note that here dielectric losses are ignored, which are likely to be low at a frequency of 100 MHz.

The impedance of the device is given as $Z0=(a/b)SQRT(\mu/\varepsilon)$, where a is the separation distance between the plate electrodes and b is the width of each plate electrode.

TABLE 1

| | Column Number | | | | |
|---|---|---|---|---|---|
| | 1 | 2 | 3 | 4 | 5 |
| Frequency | 100 MHz | | | | |
| Pitch of mesh/wires, p | 100 μm | | | | |
| Stability of m/z 100 | 0.195 | | | | |
| Eo for 1 Volt @m/z 1000 | 4000000 V/m | | | | N/A |
| Plate width, b | 3 mm | | | 30 mm | 30 mm |
| Plate separation, a | 0.2 mm | | | 2 mm | 2 mm |
| Relative permittivity | 1 | 10 | 100 | 10 | 10 |
| Q-factor | 30.3 | 30.3 | 30.3 | 303 | 303 |
| Quarter wavelength | 75 cm | 23.7 cm | 7.5 cm | 23.7 cm | 23.7 cm |
| Characteristic Impedance | 25 Ohms | 8 Ohms | 2.5 Ohms | 8 Ohms | 8 Ohms |
| RF Voltage between plates | 800 V | 80 V | 8 V | 800 V | 80 V |
| Power for λ/4 | 664 Watts | 20.7 Watts | 0.64 Watts | 207 Watts | 2.07 Watts |

Columns 1, 2 and 3 of Table 1 above show that increasing the relative permittivity, εr, of the material between the plate electrodes of the ion guide reduces the power requirements to achieve the required field strength in the vacuum, while keeping the Q-factor constant. Increasing the permittivity of the material for a particular applied voltage increases the electric flux within the ion guide. The continuity conditions mean that the perpendicular component of electric flux must be a constant across boundaries of the dielectric material, so there is an increase in electric field at the ion receiving region of the device. This results in a strong dependence of power on permittivity, which reduces as εr to the power of 1.5 for a chosen plate width and separation. It should also be understood that the wavelength of the electromagnetic radiation is inversely proportional to the square root of the relative permittivity. This can be exploited to shrink the device in the wave propagation direction to manageable levels, i.e. providing a relatively high permittivity material between the plate electrodes enables the length of the device to be made shorter whilst maintaining a standing wave pattern. Note that for the chosen transverse dimensions, b=3 mm and a=0.2 mm, increasing the permittivity leads to a reduction in characteristic impedance which needs to be taken into account if connecting different sections of ion guide together or for coupling to power output stages.

It can also be seen from Table 1 that increasing the size of the ion guide (i.e. separation a and plate width b), while keeping the aspect ratio (i.e. a:b) the same, increases the Q-factor of the device, but that the increased separation a means that in order to get the required electric field strength more power is required. The effect of increasing the size of the ion guide while keeping the characteristic impedance constant (by keeping constant aspect ratio) is shown in column 4 of Table 1. Consequently, for most efficient power consumption it is advantageous to change the scale of the device in order to keep impedance matching conditions, while keeping the field at its highest at the oscillatory anti-node of the standing wave where the active portion of the device is located. This concept is exploited in the embodiment of FIG. 7.

Figure 7:
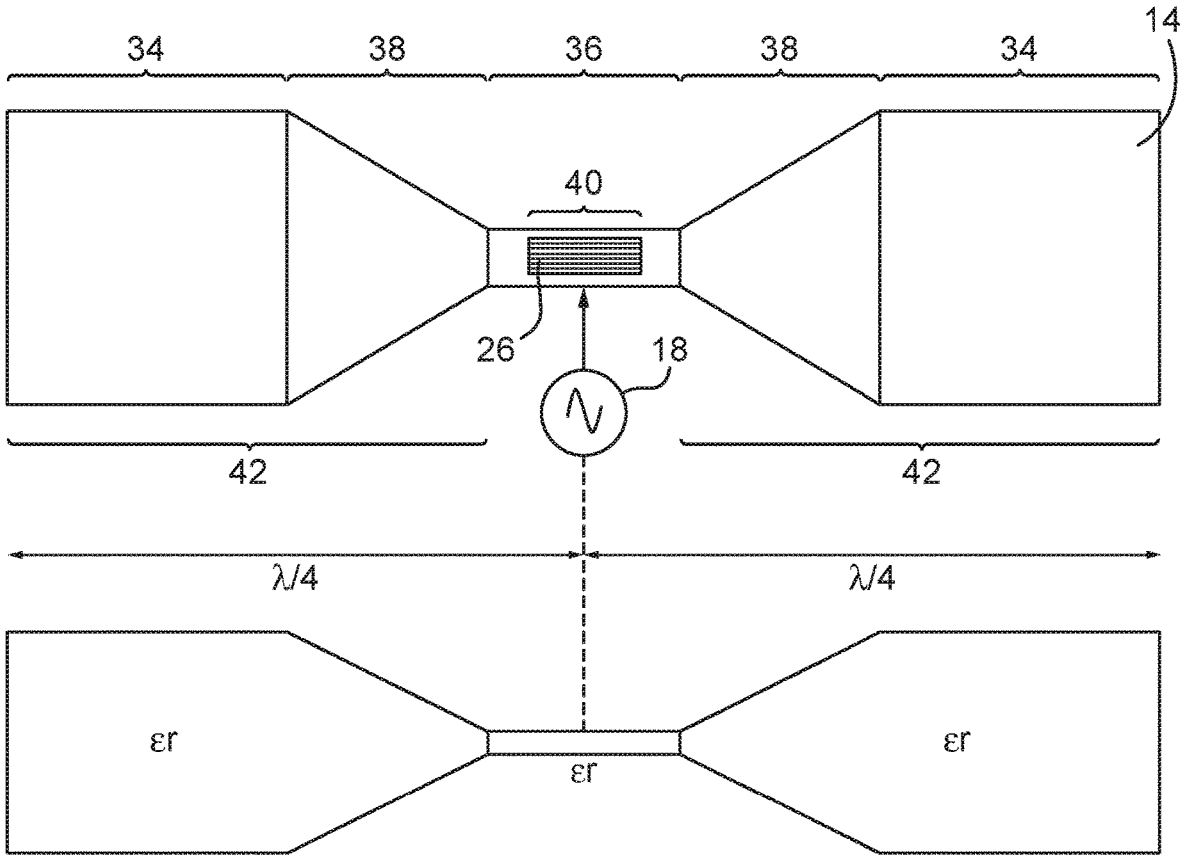
FIG. 7 shows an ion guide according to another embodiment having a central, narrow ion guiding region and which tapers outwardly to outer, wider non-ion guiding regions.

FIG. 7 shows a plan view of an embodiment that is substantially the same as that shown in FIG. 5, except that the transverse dimension b of each plate electrode 14,16 varies along the length of the device. Each plate electrode 14,16 has a longitudinal end portion 34 at each longitudinal end that has a relatively wide transverse dimension, and a longitudinal central portion 36 between the end portions that has a relatively narrow transverse dimension. The mesh 26 is arranged in the central portion of one (or both) plate electrode 14,16. The central narrow portion 36, and hence the mesh 26, is arranged at the anti-node of the standing wave 24 where the magnitude of the oscillatory electric field is highest. Power dissipation is highest in the centre of the device, which is smaller and also at the peak of the wave. Each plate electrode 14,16 has a tapered portion 38 between the central narrow portion 36 and each longitudinal end portion 34. Each tapered portion 38 progressively increases in transverse dimension in a direction from the central portion 36 towards the longitudinal end. This may help impedance match the portions of the device having different transverse dimensions. A trapping electrode 32 may be arranged facing the mesh in the same manner as described in relation to FIG. 6. The device may form a central ion guiding region 40 and non-ion guiding regions 42 arranged longitudinally outwards therefrom.

Figure 8:
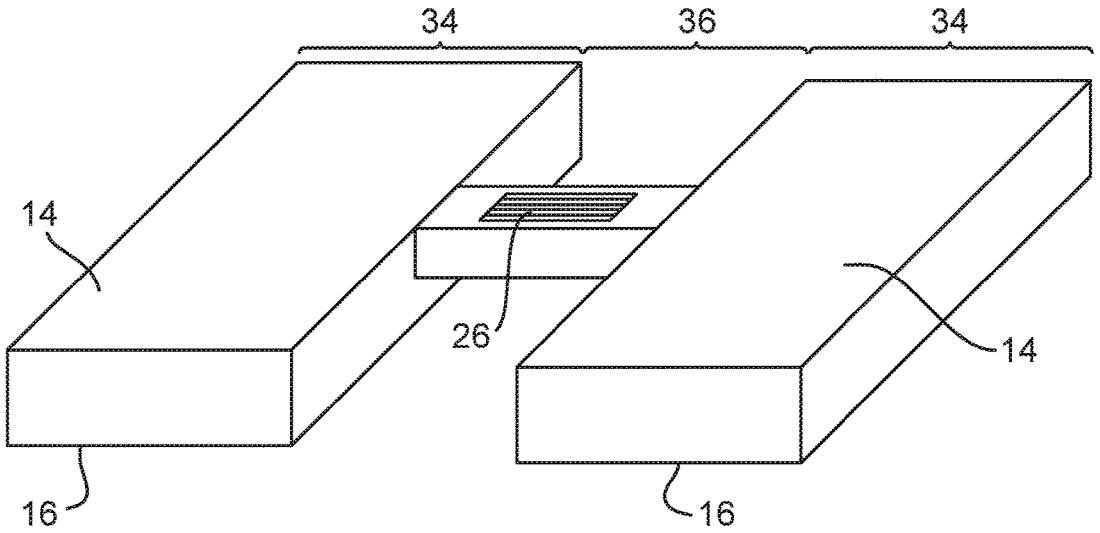
FIG. 8 shows an ion guide according to another embodiment having a central, narrow ion guiding region and outer, wider non-ion guiding regions.

FIG. 8 shows an embodiment that is similar to that shown in FIG. 7, except that the device does not have the tapered portions 38. In this embodiment (and the other embodiments), the plate electrodes 14,16 may mounted on printed circuit boards (PCBs). For example, the plate electrodes may be the conductive tracks (e.g. copper tracks) on the PCB. The skin depth of the conductive tracks at higher frequencies is relatively low and so the conductive tracks on the PCB substrate do not need to be particularly thick. For example, the skin depth of copper is only 6 microns at 100 MHz. The substrate of the PCB may be a ceramic material, which is advantageous as it has a high tolerance to heat. The PCB substrate and/or either one of the electrodes may be used as a heat sink to remove the heat dissipated due to conduction and dielectric losses and conduct it away from the device. The substrate and/or either one of the electrodes may therefore be made relatively thick.

Figure 9:
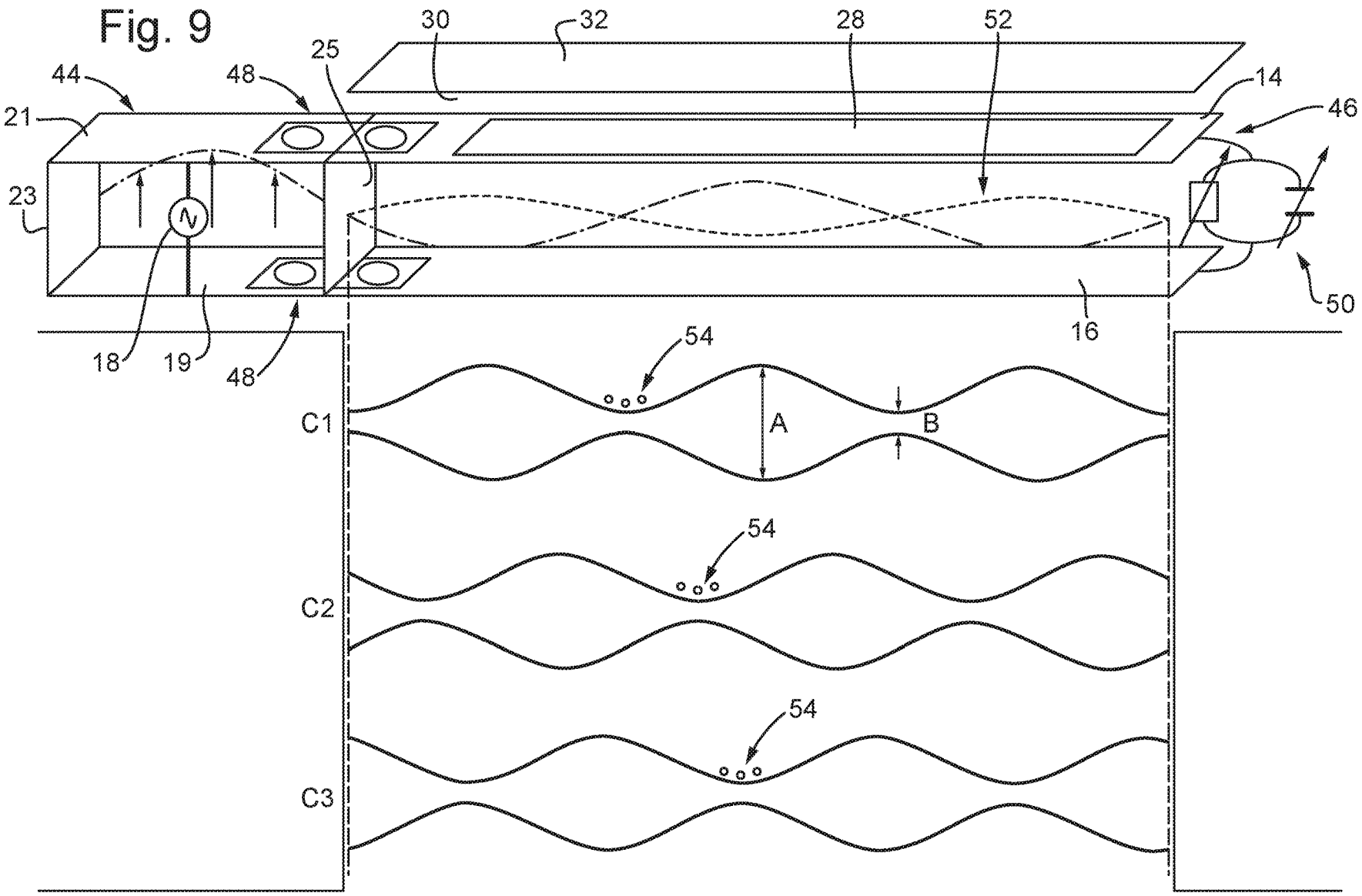
FIG. 9 shows an ion guide according to another embodiment comprising a resonator in series with a transmission line and coupled thereto by feed and pick-up electrodes.

FIG. 9 shows a perspective view of a further embodiment in which a microwave resonator 44 is used to supply a signal to a section of a transmission line 46. This embodiment comprises a resonator 44 coupled to a transmission line 46 by apertured feed and pick-up electrodes 48. The resonator 44 may be of the form described in relation to FIG. 4, e.g. a half wave resonator. The transmission line 48 may be formed by two parallel plate electrodes 14,16 that are coupled at one end to the resonator 44 and are terminated at the other end by a load 50 comprising a resistive component and a reactive component. The upper electrode 14 of the transmission line 46 comprises a mesh 28 and a trapping electrode 32 is provided facing the mesh. The form of the mesh and trapping electrode may be the same as those described above in relation to the other embodiments.

In operation, the RF voltage supply 18 applies an RF voltage to the plate electrodes 19,21 of the resonator 44 so as to set up a standing wave in the resonator. In the resonator the two plate electrodes 19,21 are short-circuited at the ends 23,25, thereby providing a load at each end which causes complete reflection of the wave and produces an infinite standing wave ratio (SWR) with nodes and antinodes at half wavelength intervals along the resonator. The resonator 44 feeds the transmission line 46 using the apertured feed and pick-up electrodes 48 to couple the signal between the resonator and transmission line, as is known in microwave communications. However, it should be understood that this is one of many known schemes for coupling resonators to transmission lines that are familiar to those skilled in the art and other coupling schemes may be used. The wave travels along the transmission line 46 and is reflected at one end by the load 50 comprising the resistive and reactive components and at the other end 25 that is coupled to the resonator 44. The impedance of the load 50 is not matched to the impedance of the transmission line 46 such that a standing wave 52 is set up along the transmission line 46, as shown in FIG. 9. This is in contrast to the case of a purely matched load, in which no reflection would take place and there would be no standing wave pattern.

The electric field from the standing wave 52 in the transmission line 46 penetrates through the mesh 28 in the upper plate electrode 14 so as to provide a force that repels ions in a direction from the mesh towards the trapping electrode 32. A DC voltage may be supplied to the trapping electrode 32 so as to arrange a DC potential difference between the trapping electrode and the electrode 14 having the mesh 28 therein. This DC potential difference is arranged so as to drive the ions away from the trapping electrode 32 and towards the electrode 14 having the mesh therein. At a location between the mesh electrode 14 and the trapping electrode 32, the driving force on the ions caused by the DC potential difference is balanced by the opposing driving force on the ions due to the penetrating electric field. The ions are therefore confined in the direction between the trapping electrode 32 and mesh 28 at this location. The standing wave pattern 52 in the transmission line 46 comprises nodes and antinodes. The resulting electric field that penetrates through the mesh 28 therefore varies in magnitude along the length of the mesh (i.e. in the direction from the resonator 44 to the load 50) so as to result in axial potential wells at locations along the length that correspond to the locations of the nodes. Ions are trapped in the axial direction by these axial potential wells, as shown in FIG. 9.

It is envisaged that a standing wave ratio (SWR) of 2 would be sufficient to trap ions in the effective potential wells at the nodes. The SWR is the ratio of the amplitude A at an anti-node to the amplitude B at a node. The SWR can be calculated from the equation $SWR=(1+|\rho|)/(1-|\rho|)$, where $\rho$ is the reflection coefficient defined by $\rho=(ZI-Z0)/(ZI+Z0)$, and where ZI is the impedance of the load 50 and Z0 the characteristic impedance of the transmission line 46.

It is evident from these equations that the magnitude and phase of the reflected wave can be changed by varying the of the load characteristics. For example, a change in capacitance in the load 50 causes a change in the phase of the reflected wave in the transmission line 46. This change in phase causes the position of the nodes and the antinodes to move along the length of the transmission line at the rate of the change in capacitance. This could be accomplished, for example, using a varactor diode, which is a commonly used component in microwave systems whose capacitance varies as a function of an applied DC voltage and has a variable resistance. FIG. 9 shows how the nodes and antinodes are located at different positions along the length of the transmission line 46 as the capacitance is varied from C1 to C2 to C3. Ions 54 may therefore be propelled along the length of the transmission line 46 simply by changing the phase of the reflection coefficient. It will therefore be appreciated that this embodiment provides a travelling wave device that can be produced with relatively few electrical components and without the need for cumbersome and complicated electronics or multiple electrical connections of the devices. The speed and characteristics that ions are driven along the device may be controlled by varying the load at the end of the transmission line.

By changing the phase of the standing wave rapidly ions can be made to separate according to their m/z or their ion mobility, e.g. in ways similar to those in U.S. Pat. Nos. 8,835,839, 8,901,490, and 8,907,273.

The resistive portion of the load 50 may be altered so as to alter the RF effective potential. For example, if the ion trapping region 30 is used to pulse ions into a TOF region, then the resistive portion of the load 50 may be rapidly switched to a low value so as to reduce the RF effective potential in preparation for accelerating ions into the TOF region.

Figure 10A:
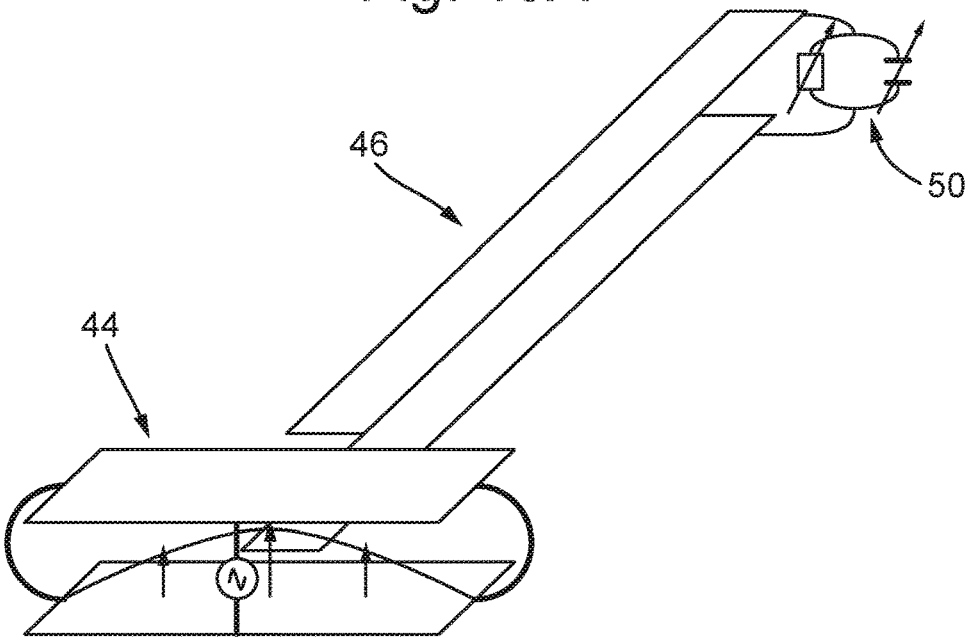
FIGS. 10A and 10B show ion guides according to other embodiments wherein the resonator is inductively coupled to the transmission line.

FIG. 10A shows a perspective view of another embodiment that is substantially the same as that shown and described in relation to FIG. 9, except that the resonator 44 is inductively coupled to the transmission line 46 rather than being coupled via feed and pick-up electrodes 48. The resonator 44 is arranged such that the standing wave in the resonator is orthogonal to the standing wave in the transmission line 46. The end of the transmission line 46 that is coupled to the resonator 44 is coupled at the location where the resonator anti-node voltage is. Although not shown, the transmission lines 46 includes a mesh 28 and a trapping electrode 32, as described in relation to FIG. 9.

Figure 10B:
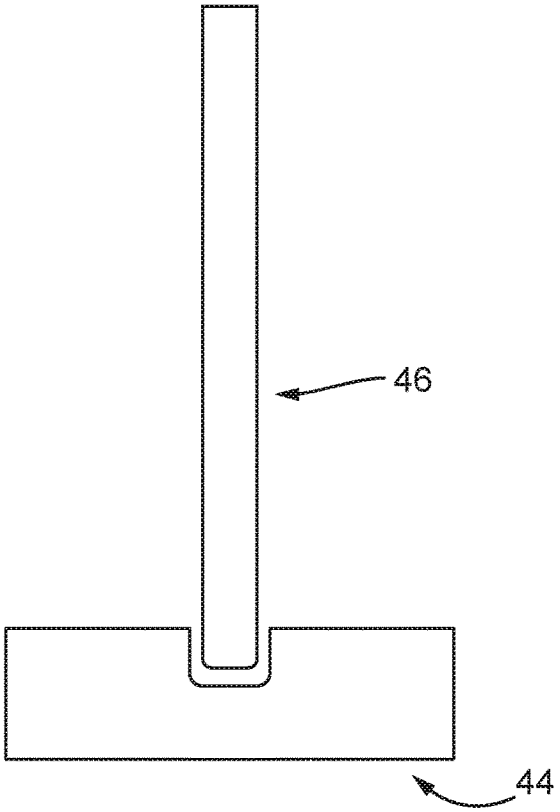

FIG. 10B shows a top view of a schematic of another embodiment that is substantially the same as that shown in FIG. 10A, except wherein the end of the transmission line 46 is embedded into the resonator 44. This increases the inductive coupling between the resonator and transmission line.

Figure 11:
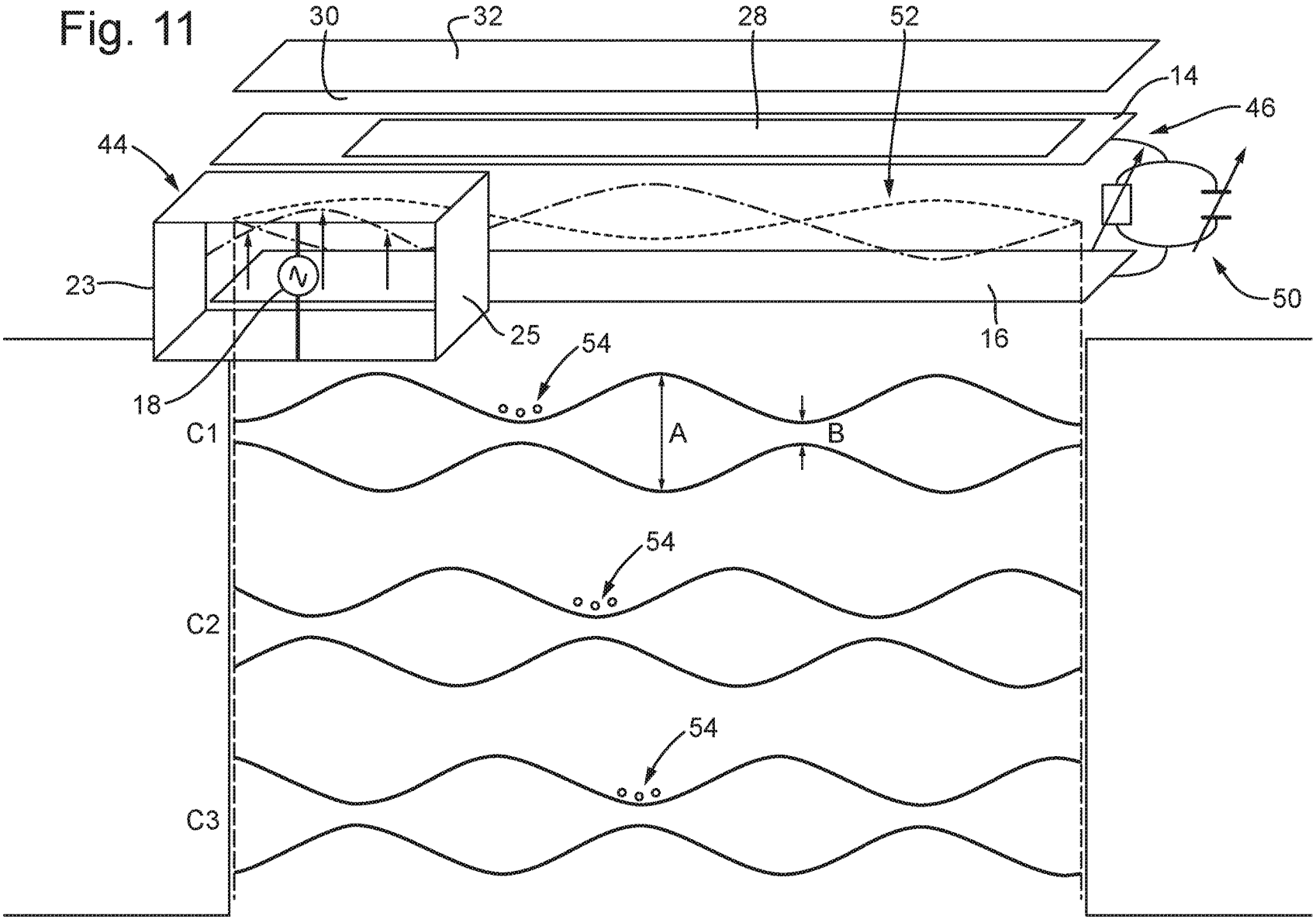
FIG. 11 shows an ion guide according to another embodiment comprising a resonator in parallel with a transmission line and inductively coupled thereto.

FIG. 11 shows a schematic of another embodiment that is substantially the same as that described in relation to FIG. 9, except that the resonator 44 is arranged laterally of the transmission line 46 and in parallel with it, rather than end-to-end with the transmission line. The axis of the standing wave in the resonator is parallel with the axis of the standing wave in the transmission line, but the two axes are spaced apart in a direction orthogonal to the axes. The resonator 44 may be inductively coupled to the transmission line 46, as in FIG. 10A, rather than coupled via feed and pick-up electrodes.

As described in the above embodiments, the AC or RF voltage supply and the electrodes may form a resonator (e.g. a microwave resonator), or the AC or RF voltage supply may form a resonator (e.g. microwave resonator) that is coupled to the pair of electrodes, for example by inductive coupling, so as to generate the standing wave between the pair of electrodes. However, it is alternatively contemplated that a voltage amplifier may be connected to the pair of electrodes so as to generate the standing wave between the pair of electrodes.

Figure 12:
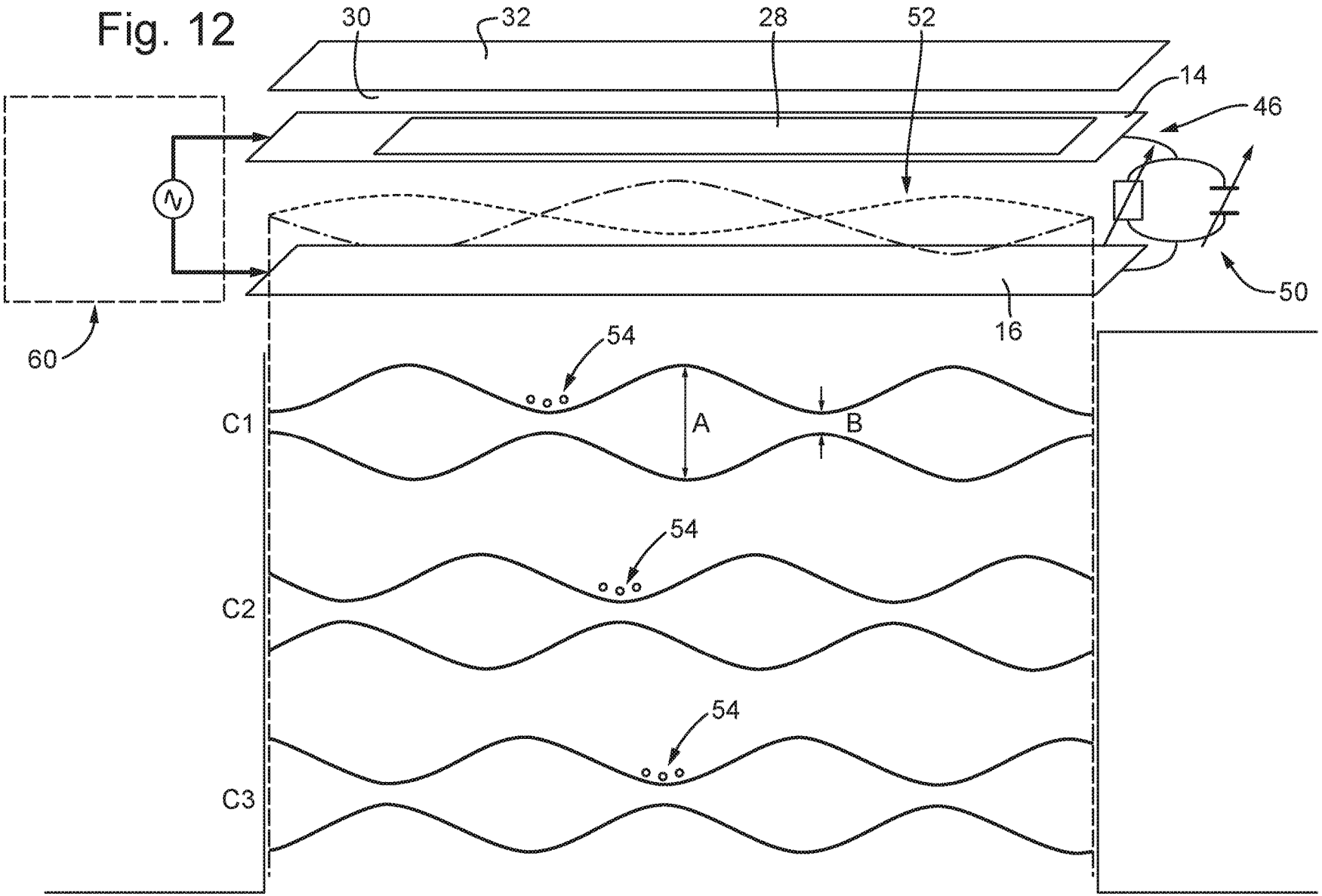
FIG. 12 shows an ion guide according to another embodiment comprising an amplifier/oscillator connected to the electrodes of a transmission line.

FIG. 12 shows a schematic of an embodiment that is substantially the same as that shown and described in relation to FIG. 9, except that in the embodiment of FIG. 12 the resonator 44 is replaced by an AC or RF amplifier/oscillator 60 having electrical outputs connected to the pair of electrodes 14,16. The amplifier/oscillator 60 supplies an AC or RF voltage to the electrodes 14,16 that generates the standing wave between the pair of electrodes.

For purposes of simplicity the resonator and the transmission line are shown in the above various embodiments as having the same cross sectional shape and size. However, it is contemplated that the resonator and transmission line may have different cross sectional shapes and/or sizes.

It will be appreciated that the embodiments described have a number of advantages. For example, the embodiments have a relatively simple structure and associated electronics. Ions may be trapped or guided using only three electrode strips. Transistor banks are not required for switching multiple electrodes, as in prior art devices such as those in U.S. Pat. Nos. 8,835,839, 8,901,490, and 8,907,273. As the device is has a simple structure, it may be arranged as an ion guide through the differential pumping aperture between two vacuum chambers maintained at different pressures. The device may be made relatively small and operated with a relatively high frequency RF voltage. The device may therefore have a relatively small phase space volume. Resonator and transmission line losses are purely due to conduction and so are easy to calculate.

The device described herein may be used for a number of purposes in a mass and/or ion mobility spectrometer. For example, the device may be an ion guide for guiding ions through the ion receiving region; an ion trap for trapping ions in the ion receiving region; an ion accelerator for pulsing ions out of the ion receiving region; an ion fragmentation or reaction device for fragmenting or reacting ions in the ion receiving region; a mass filter for mass filtering ions; or a mass analyser.

For example, with reference to FIGS. 6A-6B, the ion receiving region 30 between the trapping electrode 32 and the upper plate electrode 14 may form the extraction region of a TOF mass analyser. Ions may be trapped in the ion receiving region 30 in a trapping direction extending between the upper plate electrode 14 and the trapping electrode 32, as described herein. Ions may also be temporarily confined in the plane orthogonal to that trapping direction by DC electrodes. Ions may then be pulsed out of the ion receiving region 30 in the plane orthogonal to that trapping direction, and into the time of flight region of the TOF analyser so that the ions travel to the detector. The time of flight between the ion pulse and the ions arriving at the detector may be used to determine the mass of the ions.

Although the present invention has been described with reference to preferred embodiments, it will be understood by those skilled in the art that various changes in form and detail may be made without departing from the scope of the invention as set forth in the accompanying claims.

For example, in all embodiments where the active ion guiding element (the mesh containing portion) is fed by other kinds of structure, the structures themselves can take many different forms. In FIG. 7, for example, the tapered non-guiding lower loss regions 38 could be replaced by dielectric filled coaxial elements closely connected to the ion guiding region by short wires. In FIG. 9 the feed resonator 44 to the transmission line 46 could be a rectangular cavity resonator with an aperture feed and ground coupling.

It is contemplated that the voltage feeds at the voltage anti-nodes could be replaced by current feeds at the nodes.

The active ion guide region is only required to support TEM modes of operation required for the high field needed for the effective potential. Although plate electrode ion traps and ion guides have been described, other structures may be used such as ion traps or ion guides having coaxial electrodes.

The invention claimed is:

1. An ion manipulation device comprising:

an ion receiving region for receiving ions;

a pair of electrodes adjacent the ion receiving region; and an AC or RF voltage supply arranged to apply an AC or RF voltage to said electrodes, or arranged and configured to generate an electromagnetic field that couples to said electrodes in use, such that an electromagnetic standing wave is generated between said electrodes;

wherein a first of the electrodes comprises one or more apertures through which an electric field from the standing wave penetrates and enters the ion receiving region, in use, for urging said ions away from the one or more apertures.

2. The device of claim 1, further comprising a trapping electrode facing the apertures so as to define said ion receiving region therebetween, and a voltage supply configured to supply a potential difference between the trapping electrode and the one or more apertures for urging ions in a direction towards the apertures.

3. The device of claim 1, wherein each of the pair of electrodes has a length in a direction parallel to the axis of the standing wave and a width in a dimension orthogonal to the axis of the standing wave, and wherein the width of each electrode increases and/or decreases along its length.

4. The device of claim 3, wherein the first electrode has a narrow portion comprising said one or more apertures and a wider portion at, or towards, one or both longitudinal end of the first electrode.

5. The device of claim 4, wherein the width of the electrode progressively tapers from the narrow portion to the wider portion at one or both longitudinal ends of the first electrode.

6. The device of claim 1, comprising a solid dielectric material arranged between the pair of electrodes.

7. The device of claim 6, wherein the solid dielectric material is a substrate of a printed circuit board, optionally wherein the electrodes are printed on the printed circuit board.

8. The device of claim 1, wherein the first electrode is sheet metal electrode having said one or more apertures therethrough.

9. The device of claim 1, wherein said first electrode is a mesh or comprises a mesh providing said apertures; optionally wherein said mesh is a grid or is a plurality of wires defining elongated apertures between the wires.

10. The device of claim 1, wherein said one or more apertures are arranged so as to be adjacent an anti-node of the standing wave, in use.

11. The device of claim 1, wherein each electrode of the pair of electrodes has first and second longitudinal ends and a length extending therebetween, wherein the electrodes are spaced apart, and wherein the first ends of the electrodes are electrically connected to each other and the second ends of the electrodes are electrically connected to each other.

12. The device of claim 11, wherein the first ends and/or second ends of the electrodes are electrically connected so as to form a short circuit.

13. The device of claim 1, wherein the first ends and/or second ends are electrically connected by a load that is not impedance matched to the electrodes.

14. The device of claim 13, further comprising a controller for varying the impedance of the load with time.

15. The device of claim 1, wherein the AC or RF voltage supply is configured to generate the AC or RF voltage having a frequency of: ≥20 MHz; ≥40MHz; ≥60 MHz; ≥80 MHz; ≥100 MHz; ≥120 MHz; ≥140 MHz; ≥160 MHz; ≥180 MHz; or ≥200 MHz.

16. An ion manipulation device comprising:

an ion receiving region for receiving ions;

a transmission line arranged adjacent to the ion receiving region, wherein the transmission line comprises a pair of electrodes for transmitting electromagnetic waves terminated by a load that is impedance matched to the transmission line; and an AC or RF voltage supply arranged to apply an AC or RF voltage to said electrodes, or arranged and configured to generate an electromagnetic field that couples to said electrodes in use;

wherein a first of the electrodes comprises one or more apertures through which an electric field of said electromagnetic waves penetrates and enters the ion receiving region, in use, for urging said ions away from the one or more apertures.

17. A mass or ion mobility spectrometer comprising the device of claim 1, optionally further comprising a flight region and wherein the device is configured to pulse ions from the ion receiving region into the flight region.

18. The spectrometer of claim 17, wherein the spectrometer is a time of flight mass spectrometer.

19. A method of mass or ion mobility spectrometry comprising:

providing an ion manipulation device as claimed in claim 1;

supplying ions to, or generating ions in, said ion receiving region;

applying said AC or RF voltage to said pair of electrodes, or generating an electromagnetic field with said AC or RF voltage supply that couples to said electrodes, such that an electromagnetic standing wave is generated between said electrodes and said electric field from the standing wave penetrates through said one or more apertures and enters the ion receiving region so as to urge ions away from the one or more apertures.

20. A method of mass or ion mobility spectrometry comprising:

providing an ion manipulation device as claimed in claim 16;

supplying ions to, or generating ions in, said ion receiving region;

applying said AC or RF voltage to said pair of electrodes, or generating an electromagnetic field with said AC or RF voltage supply that couples to said electrodes, such that an electromagnetic wave travels along the transmission line and an electric field from the electromagnetic wave penetrates through said one or more apertures and enters the ion receiving region so as to urge ions away from the one or more apertures.

* * * * *